US005255897A

United States Patent [19]

Pepper

[11] Patent Number: 5,255,897

[45] Date of Patent: Oct. 26, 1993

[54] MODULAR FENCE

[75] Inventor: Kenneth V. Pepper, Plymouth, Wis.

[73] Assignee: Bemis Manufacturing Company, Sheboygan Falls, Wis.

[21] Appl. No.: 27,556

[22] Filed: Mar. 5, 1993

Related U.S. Application Data

[63] Continuation of Ser. No. 667,190, Mar. 11, 1991.

[51] Int. Cl.[5] ..... E04H 17/16

[52] U.S. Cl. ..... 256/24; 256/66; 256/65; 256/67; 256/59

[58] Field of Search ..... 256/24, 65, 66, 67, 256/59

[56] References Cited

U.S. PATENT DOCUMENTS

| | | | |
|---|---|---|---|
| 2,997,277 | 8/1961 | Schwartz | 256/24 |
| 3,385,567 | 5/1968 | Case et al. | 256/65 X |
| 3,700,213 | 10/1972 | Blease | 256/19 |
| 3,879,017 | 4/1975 | Maxcey et al. | 256/65 |
| 3,910,560 | 10/1975 | Goetz | 256/24 |
| 3,910,561 | 10/1975 | Fornells | 256/65 |
| 4,014,520 | 3/1977 | Walters | 256/65 X |
| 4,124,198 | 11/1978 | Wong | 256/24 |
| 4,403,767 | 9/1983 | Basey | 256/66 |
| 4,623,128 | 11/1986 | Dutch et al. | 256/65 |
| 4,702,459 | 10/1987 | Moschner | 256/19 |
| 4,722,514 | 2/1988 | Pettit | 256/66 X |
| 4,809,955 | 3/1989 | Veilleux | 256/59 X |
| 4,928,930 | 5/1990 | Chung | 256/65 |
| 4,958,807 | 9/1990 | Wylie | 256/65 |

*Primary Examiner*—Dennis L. Taylor
*Assistant Examiner*—Heather Chun
*Attorney, Agent, or Firm*—Michael, Best & Friedrich

[57] ABSTRACT

A modular fence comprising at least two vertical end posts, a pair of vertically spaced, horizontal rails extending between the end posts and having ends connected to respective end posts by post connector members which allow for expansion and contraction of the rails, a plurality of horizontally spaced, vertical intermediate posts extending between the rails and having ends connected to respective rails by rail connector members which allow for expansion and contraction of the intermediate posts, and members located between adjacent intermediate posts for filling the spaces between the intermediate posts.

21 Claims, 3 Drawing Sheets

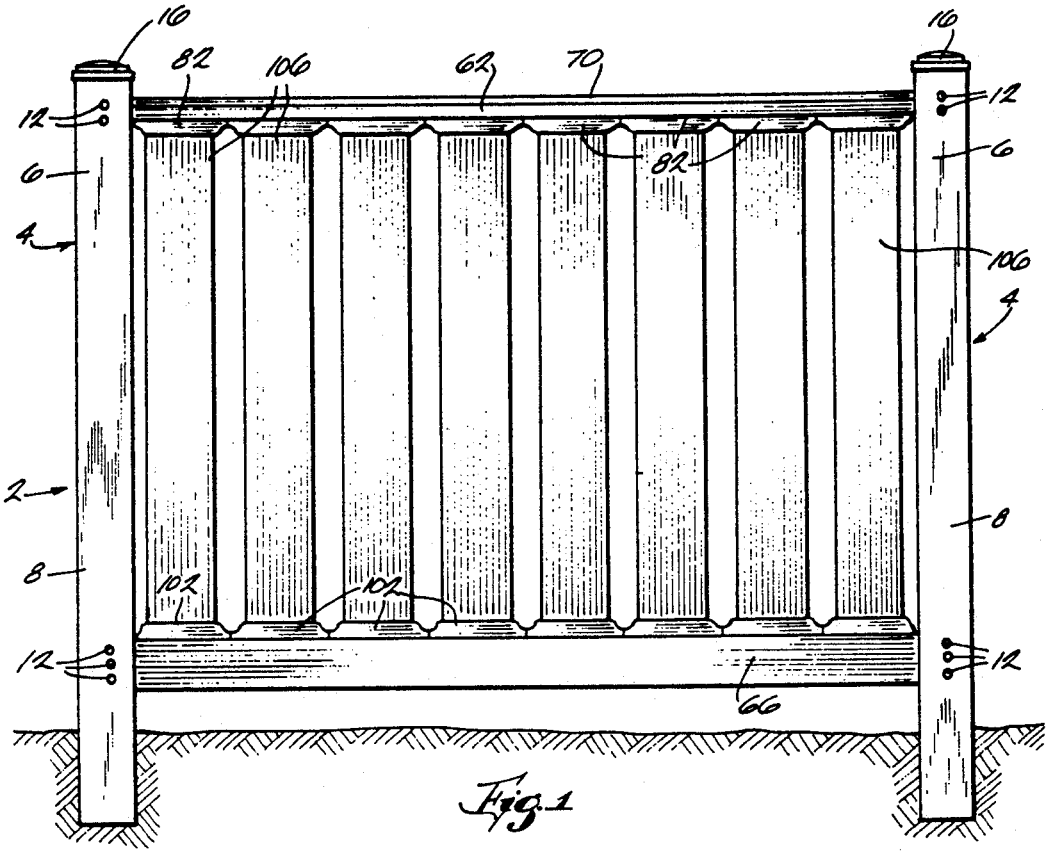
Fig. 1
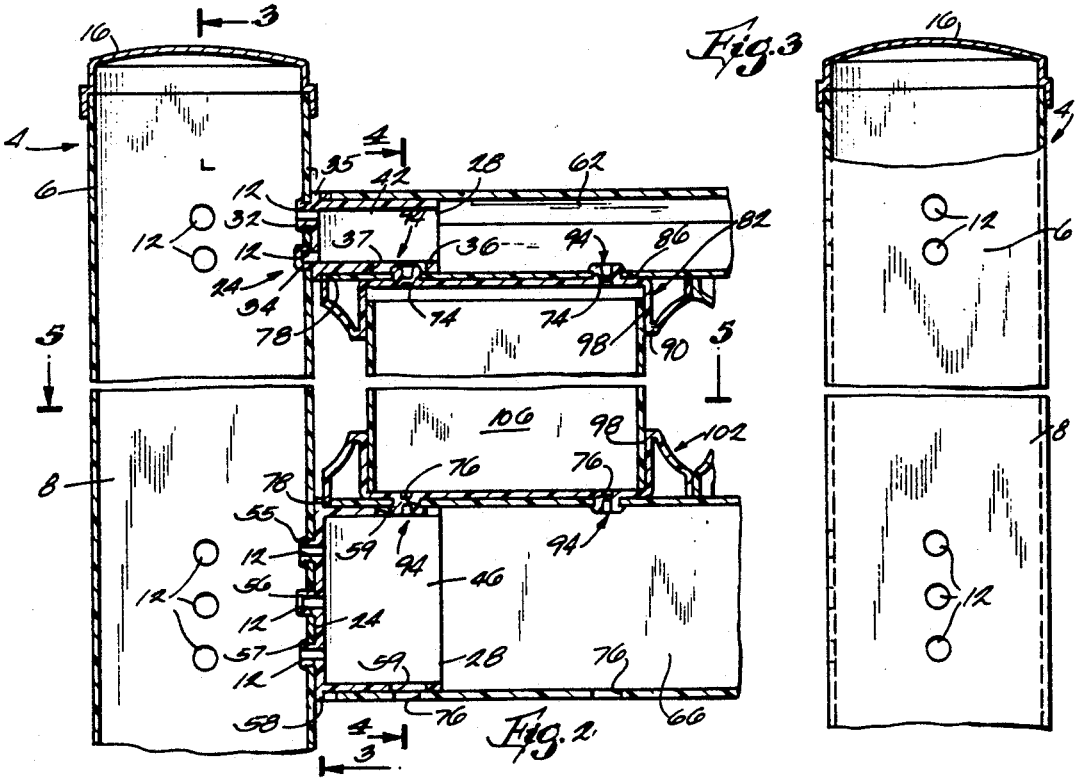
Fig. 3
Fig. 2

MODULAR FENCE

This is a continuation of co-pending application Ser. No. 667,190, filed Mar. 11, 1991.

BACKGROUND OF THE INVENTION

1. Field of the Invention

This invention relates to fences, and more particularly, to modular fences.

2. Description of the Prior Art

The posts and rails of fences have typically been made of wood. However, since the cost of lumber has been escalating in recent years and since wood fences require constant maintenance such as painting or staining and prevention of rotting, other materials have been tested for use in making fences.

Fences having plastic rails which snap into plastic posts are known. Typically, these plastic rails have snap-in connections on their ends and they "snap-in" directly to the plastic posts. Problems with this type of plastic fence construction include the fact that these constructions do not take into account the expansion and contraction of the plastic and also that the rails may tend to rotate. Further, some of these plastic fences are made of a flexible elastic material which will result in sagging rails and bending posts.

SUMMARY OF THE INVENTION

The invention provides a modular fence comprising a vertical post, a horizontal rail having an end, and a post connector member connected to the end of the rail, one of the post connector member and the post having thereon a projection and the other of the post connector member and the post having therein a recess receiving the projection.

The invention also provides a modular fence comprising a vertical post, a horizontal rail, and means for connecting the rail and the post and for allowing expansion and contraction of one of the post and the rail.

The invention also provides a modular fence comprising a rail connector member, a vertical post having an end connected to the rail connector member, and a horizontal rail, one of the rail connector member and the rail having thereon a projection and the other of the rail connector member and the rail having therein a recess receiving the projection.

The invention also provides a modular fence comprising two spaced, generally parallel first members, a pair of spaced second members extending between the first members and generally perpendicular thereto and having therebetween a space, and means for filling the space between the second members.

A principal feature of the invention is the provision of a post connector member which engages an end post and slideably engages one end of a rail. This post connector member provides integrity for the modular fence and also allows for the expansion and contraction of the rail.

Another principal feature of the invention is the provision of a post connector member and a vertical post interengaged by a projection on the post connector member and a recess which is located in the post and which receives the projection.

Another principal feature of the invention is the provision of a rail connector member and a horizontal rail connected to each other by a projection on the rail connector member and a recess in the rail, which recess receives the projection.

Another principal feature of the invention is the provision of means for filling the space between two parallel, spaced posts or rails.

Another principal feature of the invention is its ease of assembly. This modular fence can be assembled using only a mallet to engage the connector members.

Other features and advantages of the invention will become apparent to those skilled in the art upon review of the following detailed description, claims and drawings.

DESCRIPTION OF THE DRAWINGS

FIG. 1 is a front view of a modular fence in accordance with the teachings of the present invention.

FIG. 2 is a fragmentary sectional view of the fence illustrated in FIG. 1.

FIG. 3 is a sectional view taken along line 3—3 in FIG. 2.

Figure 4:
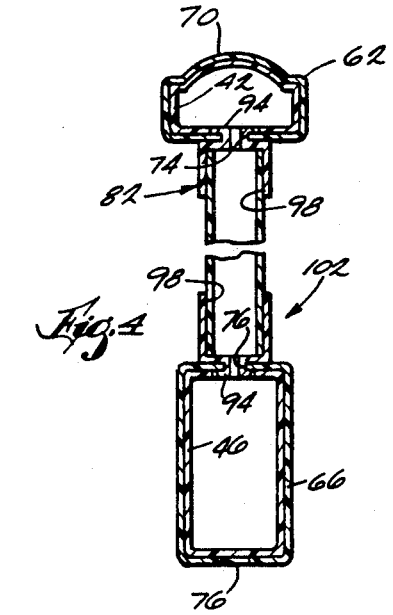
FIG. 4 is a sectional view taken along line 4—4 in FIG. 2.
Figure 5:
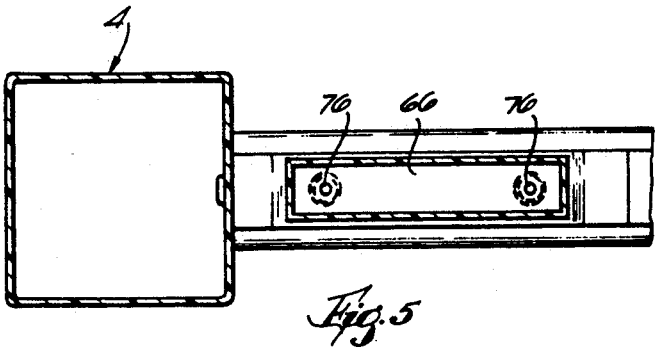
FIG. 5 is a sectional view taken along line 5—5 in FIG. 2.
Figure 8:
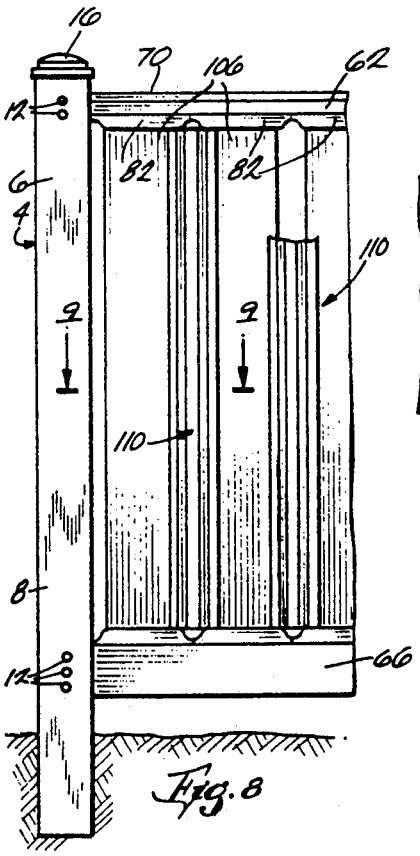
FIG. 8 is a fragmentary front view of the fence illustrated in FIG. 1 with spacers between the intermediate posts.
Figure 9:
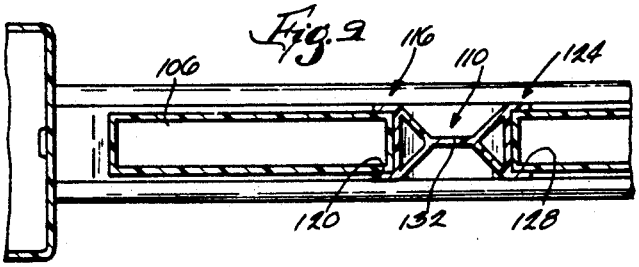
FIG. 9 is a sectional view taken along line 9—9 in FIG. 8.
Figure 6:
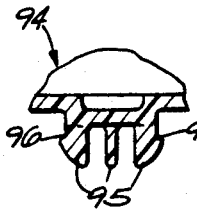
FIG. 6 is a sectional view of a projection on a rail connector member.
Figure 7:
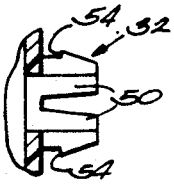
FIG. 7 is a sectional view of a projection on a post connector member.
Figure 10:
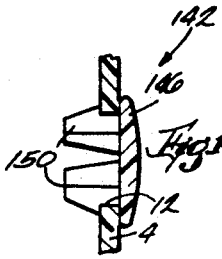
FIG. 10 is a sectional view of a hole plug.

Before one embodiment of the invention is explained in detail, it is to be understood that the invention is not limited in its application to the details of construction and arrangements of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

DESCRIPTION OF THE PREFERRED EMBODIMENT

Referring to the drawings, a modular fence 2 is illustrated in FIGS. 1-10 and includes two spaced, vertical members or end posts 4. The end posts 4 are preferably made of plastic, and are most preferably made of a rigid plastic such as polyvinyl chloride. The end posts 4 are hollow and typically have four sides, a top portion 6 and a bottom portion 8. The top and bottom portions 6 and 8 have therein recesses or openings 12 on at least two of the sides, and preferably on all four sides. Each end post 4 preferably has two openings 12 in each side of the top portion 6 of the post and three openings 12 in each side of the bottom portion 8 of the post. In this way, the end posts 4 can function as corner posts with horizontal rails communicating with the openings 12 on two adjacent sides of the end post 4, middle posts with horizontal rails communicating with the openings 12 on two opposite sides of the end post 4, or terminating posts with horizontal rails communicating with the openings 12 on one side of the end post 4. Each end post 4 further includes a post cap 16 secured to the top portion 6 of the end post 4 to provide a more pleasing appearance.

The modular fence 2 also comprises (see FIG. 2) two top post connector members 42 (only one is shown) and two bottom post connector members 46 (only one is shown). Each connector member 42 or 46 has a first or post end 24 (the left end in FIG. 2) and a second or rail end 28 (the right end in FIG. 2). The post connector members 42 and 46 are preferably made of plastic and are most preferably made of a rigid plastic such as polyvinyl chloride.

Although various constructions are possible, each top post connector member 42 preferably has two projections 32 and 34 on its first end 24. The projections 32 and 34 engage the associated end post through the two openings 12 in the top portion 6 of the end post 4. Preferably, the upper projection 32 snaps into the post 4 and includes (see FIG. 7) four arcuate portions 50 which flex inwardly to allow entry into the end post through the associated opening 12. The portions 50 have toothlike protrusions or shoulders 54 and, one inside the end post, the portions 50 flex outwardly and the shoulders 54 engage the inside of the end post so as to resist removal of the projection 32 from the post 4. The lower projection 34 is cylindrical and does not engage the inside of the end post 4. The connector 42 also includes (see FIG. 2) on its first end 24 an endless lip 35 engaging the post 4. The reason for the lip 35 is explained below. The top post connector member 42 also preferably has an aperture 36 in its second end 28. The bottom wall of the top post connector member 42 has therein an elongated opening 37, the reason for which is explained below.

Although various constructions are possible, the bottom post connector member 46 preferably has three projections 55, 56 and 57 on its first end 24. The projections 55, 56 and 57 engage the end post through the three openings 12 in the bottom portion 8 of the end post. Preferably, the projections 55 and 57 are substantially identical to the projection 32 and engage the post 4 in the same manner, and the projection 56 is substantially identical to the projection 34. The connector 46 also includes (see FIG. 2) on its first end 24 an endless lip 58 engaging the post 4. The reason for the lip 58 is explained below. The top and bottom walls of the post connector member 46 have therein respective elongated openings 59, the reason for which is explained below.

A pair of hollow, vertically spaced horizontal members or rails 62 and 66 having respective opposite ends extend between the end posts 4. The rails are preferably made of plastic, and are most preferably made of a rigid plastic such as polyvinyl chloride. As shown in FIG. 4, the top rail 62 has a rounded upper surface 70 to give it a more pleasing appearance. The lower surface of the rail 62 has therein (see FIGS. 2 and 4) a plurality of openings 74, the reason for which is explained below. The upper and lower surfaces of the rail 66 each have therein a plurality of recesses or openings 76, the reason for which is explained below.

As shown in FIGS. 2 and 4, each end of each rail 62 or 66 slideably receives a respective post connector member 42 or 46 so that each end of each rail 62 or 66 is connected to a respective end post 4. An endless, compressible spacer 78 (see FIG. 2) is located between the end of each rail 62 or 66 and the associated connector lip 35 or 58 in order to provide appropriate clearance at the time of installation to accommodate expansion of the rail 62 or 66. In an alternative construction (not shown), the connectors 42 and 46 could be constructed without the lips 35 and 58, and the spacers 78 could extend between the end post 4 and the ends of the rails 62 and 66.

Although the rails 62 and 66 slide over the post connector members 42 and 46 in the preferred embodiment of the invention, other constructions are possible. For example, the ends of the rails 62 and 66 could slide into the apertures 36 in the post connector members 42 and 46 rather than sliding over the post connector members 42 and 46.

The modular fence 2 also comprises (see FIGS. 1, 2 and 4) a plurality of rail connector members 82 connected to the lower surface of the horizontal rail 62. The rail connector members 82 are preferably made of plastic, and are most preferably made of a rigid plastic such as polyvinyl chloride. Each rail connector member 82 has (see FIG. 2) first and second or upper and lower ends 86 and 90. The upper end 86 has thereon projections 94 received in respective holes or openings 74 in the horizontal rail 62. The projection 94 closest to the end post 4 also extends through the opening 37 in the post connector member 42. The length of the opening 37 is sufficient to allow movement of the projection 94 relative to the connector 42 as a result of movement of the rail 62 relative to the connector 42 when the rail 62 expands or contracts. Although various constructions are possible, each projection 94 preferably includes (see FIG. 6)four portions 95 which flex inwardly to allow entry into the rail 62 through a hole 74. The portions 95 have toothlike protrusions or shoulders 96 and, once inside the associated rail, the portions 95 flex outwardly such that the shoulders 96 engage the inside of the rail 62 so as to resist removal of the projection 94 from the rail. The bottom end 90 of the connector member 82 has therein a rectangular recess 98, the reason for which is explained below.

The fence 2 also comprises (see FIGS. 1, 2 and 4) a plurality of rail connector members 102 connected to the upper surface of the horizontal rail 66. The rail connector members 102 are preferably substantially identical to the rail connector members 82, except that the members 102 are oriented upside down relative to the members 82, and common elements have been given the same reference numerals. Thus, the projections 94 on the lower ends of the rail connector members 102 are received in respective openings 76 in the upper surface of the rail 66. The projection 94 closest to the end post 4 also extends through the opening 59 in the upper wall of the post connector member 46. The length of the opening 59 is sufficient to allow movement of the projection 94 relative to the connector 46 as a result of movement of the rail 66 relative to the connector 46 when the rail 66 expands or contracts.

As shown in FIG. 1, a plurality of horizontally spaced, vertical intermediate members or posts 106 extend between the rails 62 and 66. The intermediate posts 106 are preferably plastic, most preferably a rigid plastic such as polyvinyl chloride. Each intermediate post 106 has an upper end slideably housed or received in the recess 98 of an associated rail connector member 82, and each intermediate post 106 has a lower end slideably housed or received in the recess 98 of an associated rail connector member 102. Thus, the rail connector members 82 connect the upper ends of the intermediate posts 106 to the upper rail 62, and the rail connector members 102 connect the lower ends of the intermediate posts 106 to the lower rail 66. As a result of the sliding receipt of the ends of the intermediate posts 106 in the recesses 98 in the rail connector members 82 and 102, the rail connector members 82 and 102 are connected to the intermediate posts 106 so as to allow for expansion and contraction of the posts 106. In the illustrated construction, the intermediate posts 106 are supported such that there is a space between adjacent posts 106.

Means are provided for filling the horizontal spaces between the intermediate posts 106. This means preferably includes (see FIGS. 8 and 9), for each space, an elongated member 110 extending vertically and engaging the adjacent intermediate posts 106. The member 110 includes (see FIG. 9) a first or left side or edge portion 116 defining an elongated recess 120 housing the edge of the intermediate post 106 located to the left of the member 110, and a second or right side or edge portion 124 defining an elongated recess 128 housing the edge of the post 106 located to the right of the member 110. The member 110 also includes a relatively thin central or connecting or web portion 132 extending between and integrally connecting the edge portions 116 and 124. During construction of the modular fence, the member 110 slides over the associated intermediate posts 106 before the intermediate posts are secured at both ends to the rail connector members 82 and 102.

The modular fence 2 further comprises (see FIG. 10) hole plugs 142 which fill the unused openings 12 in the end posts 4. Each hole plug 142 has a rounded head 146 and four arcuate portions 150 substantially identical to the arcuate portions 50 of the projections 32. The plugs 142 are connected to the posts 4 in the same manner as the projections 32 are connected to the posts 4.

Figure 11:
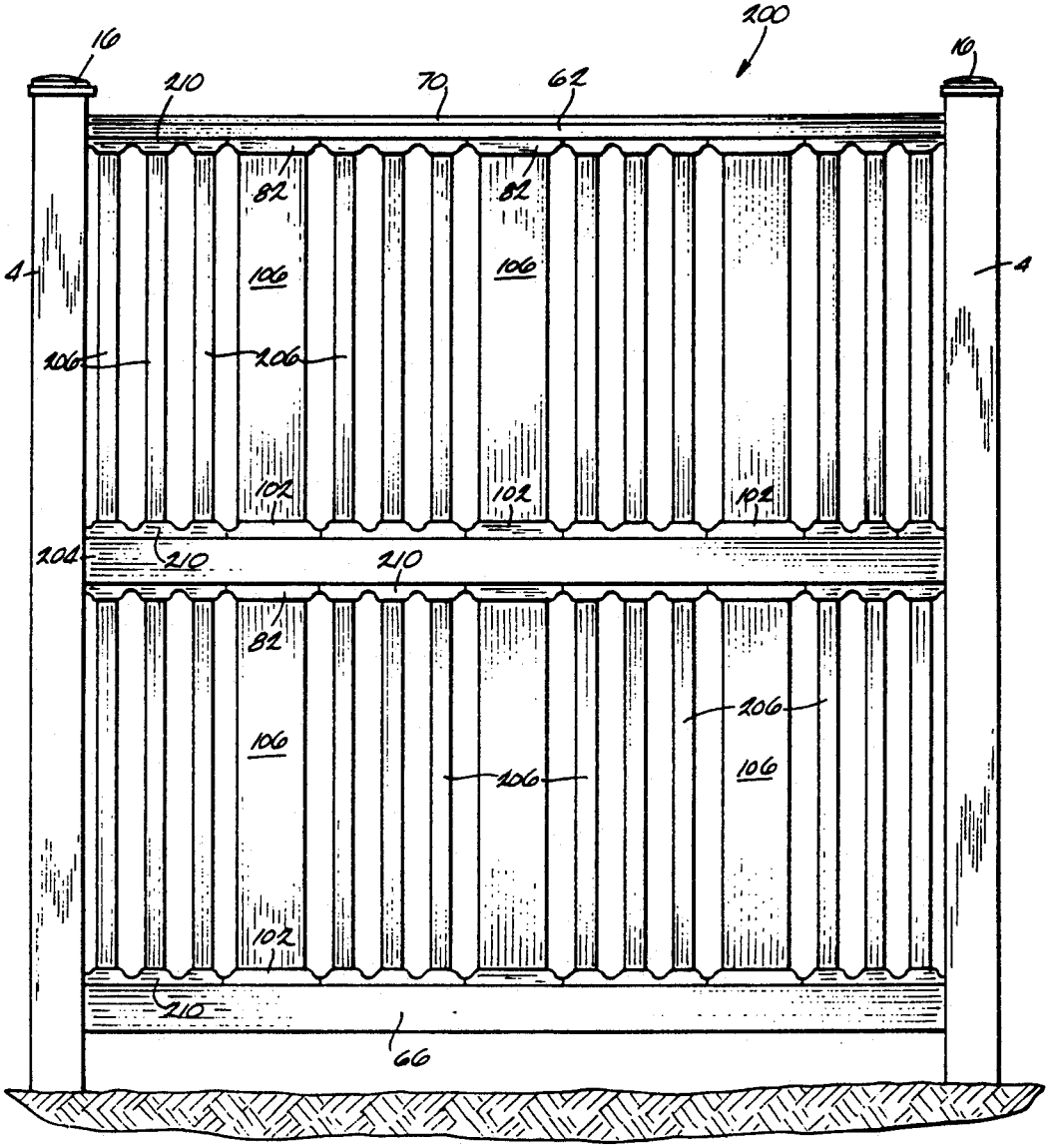
FIG. 11 is a front view of an alternative embodiment of the present invention.
Figure 12:
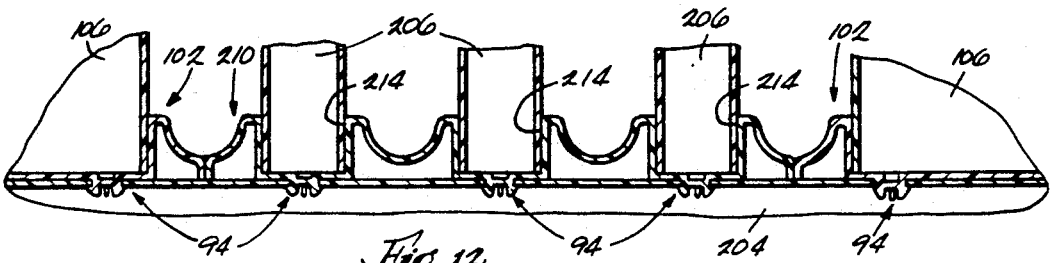
FIG. 12 is a partial sectional view of the fence shown in FIG. 11.

A modular fence 200 that is an alternative embodiment of the invention is illustrated in FIGS. 11 and 12. Except as identified below, the modular fence 200 is substantially the same as modular fence 2 and like elements have been given like numerals. In addition to the upper and lower rails 62 and 66, the modular fence 200 includes an intermediate horizontal rail 204 which is preferably substantially identical to the lower rail 66. (Each lower rail 66 is provided with openings 76 in its upper and lower surfaces so that the lower rail 66 can function either as a lower rail or as an intermediate rail. The openings in the lower surface of the rail 66 are used when the rail functions as an intermediate rail and are not used when the rail functions as a lower rail.) Intermediate posts 206 and 106 extend between the lower rail 66 and the intermediate rail 204 and between the intermediate rail 204 and the upper rail 62. The posts 206 differ from the posts 106 in that the width of the posts 206 is less. As shown in FIG. 11, the posts 106 and 206 are arranged in repeating groups of three posts 206 followed by a post 106. Thus, every fourth intermediate post is a post 106. The upper end of each post 106 is connected to the upwardly adjacent rail 62 or 204 by a connector member 82, and the lower end of each post 106 is connected to the downwardly adjacent rail 204 or 66 by a connector member 102. The ends of the posts 206 are connected to the rails 62, 66 and 204 by rail connector members 210. The rail connector members 210 are similar to the connector members 82 and 102 and are similarly connected to the holes 74 and 76 in the rails 62, 66 and 204. The main difference between the connector members 210 and the connector members 82 and 102 is that the connector members 210 are longer and each has therein three recesses 214 rather than a single recess 98. Each recess 214 slideably receives the end of an associated post 206.

Various features of the invention are set forth in the following claims.

I claim:

1. A modular fence comprising:

a vertical post, a horizontal rail having a longitudinal axis and an end generally perpendicular to said axis, and means for connecting said rail and said post and for allowing expansion and contraction of said rail, said means including a post connector member which is separate from said rail and which is connected to said end of said rail such that said rail can slide relative to said post connector member along said axis so as to allow for expansion and contraction of said rail.

2. A modular fence as set forth in claim 1 further comprising a second vertical post, a second horizontal rail vertically spaced from said first-mentioned horizontal rail and extending between said vertical posts, and two horizontally spaced vertical intermediate posts extending between said rails and having therebetween a space.

3. A modular fence as set forth in claim 2 further comprising means for filling said space between said intermediate posts.

4. A modular fence as set forth in claim 2 wherein said intermediate posts have respective opposite ends, and wherein said fence further comprises a rail connector member for each end of each intermediate post, said rail connector member connecting the associated end of the associated intermediate post with the associated rail.

5. A modular fence as set forth in claim 4 wherein one of said rail connector member and the associated rail has therein a projection and the other said rail connector member and the associated rail has therein a recess receiving said projection.

6. A modular fence as set forth in claim 4 and further comprising means including said rail connector member for allowing expansion and contraction of the associated intermediate post.

7. A modular fence as set forth in claim 1 and further comprising a second vertical post, a second horizontal rail which is vertically spaced from said first-mentioned horizontal rail and which extends between said vertical posts, a rail connector member, first means for connecting said rail connector member to said first-mentioned horizontal rail, said first means including a recess in said first-mentioned horizontal rail and a projection which is located on said rail connector member and which extends into said recess in said first-mentioned horizontal rail, an intermediate post which extends between said rails and which has an end connected to said rail connector member, and second means for allowing movement of said rail connector member with said first-mentioned horizontal rail and relative to said post connector member, said second means including a slot which is located in said post connector member and which receives said projection on said rail connector member.

8. A modular fence as set forth in claim 1 wherein said end of said rail telescopes over and slidably receives said post connector member, and wherein said means for connecting said rail and said post and for allowing expansion and contraction of said rail includes said telescoping connection of said rail and said post connector member.

9. A modular fence as set forth in claim 1 wherein one of said post connector member and said rail telescopically receives the other of said post connector member and said rail.

10. A modular fence as set forth in claim 1 wherein one of said post connector member and said post has thereon a projection and the other of said post connector member and said post has thereon a recess receiving said projection.

11. A modular fence comprising:

a vertical post, a horizontal rail, and means for connecting said rail and said post and for allowing expansion and contraction of one of said post and said rail, said means including a post connector member which is separate from both said rail and said post, which engages said post, and which slidably engages said rail, said post connector member having a first end having thereon a projection engaging said post, and a second end having therein an aperture receiving said rail.

12. A modular fence comprising:

a vertical post, a horizontal rail, and means for connecting said rail and said post and for allowing expansion and contraction of one of said post and said rail, said connecting means comprising a rail connector member which is separate from both said rail and said post, which engages said rail and which slideably engages said post.

13. A modular fence comprising:

a rail connector member, a vertical post which is separate from said rail connector member, means for connecting said rail connector member to said post, said rail connector member being in telescoping relationship with said post, whereby said means for connecting also allows for expansion and contraction of said vertical post, and a horizontal rail, one of said rail connector member and said rail having thereon a projection and the other of said rail connector member and said rail having therein a recess receiving said projection.

14. A modular fence as set forth in claim 13 further comprising a second vertical post which has an end connected to said rail and which is located such that there is a space between said vertical posts, and means for filling said space between said posts.

15. A modular fence as set forth in claim 14 further comprising a third vertical post and a post connector member engaging said third post, said rail being slideably connected to said post connector member.

16. A modular fence as set forth in claim 13 wherein said rail connector member has a first end having thereon a projection engaging said rail, and a second end having therein an aperture receiving said post.

17. A modular fence as set forth in claim 13 wherein said post has an end, wherein said rail connector member telescopes over and slidably receives said end of said post, and wherein said means connecting said rail connector member to said post includes said telescoping connection of said rail connector member and said post.

18. A modular fence comprising:

two spaced, generally parallel first members, a pair of spaced, generally parallel second members extending between said first members and generally perpendicular thereto, said second members having therebetween a space, and means for filling said space between said second members, said space filling means comprising a member including a first edge portion defining a recess partially receiving one of said second members, a second edge portion defining a recess partially receiving the other of said second members, and a central portion extending between said edge portions.

19. A modular fence comprising a horizontal rail, a vertical post, and means for connecting said rail and said post and for allowing expansion and contraction of said post, said means including a rail connector member which is separate from said post, which is connected to said rail, and which is connected to said post such that said post can slide relative to said rail connector member so as to allow for expansion and contraction of said post.

20. A modular fence as set forth in claim 19 wherein said vertical post has a longitudinal axis and an end generally perpendicular to said axis, and wherein said rail connector member is connected to said end of said post.

21. A modular fence as set forth in claim 20 wherein one of said rail connector member and said post is telescopically received by the other of said rail connector member and said post and said post slides relative to said rail connector member along said axis.

* * * * *

UNITED STATES PATENT AND TRADEMARK OFFICE

CERTIFICATE OF CORRECTION

PATENT NO. : 5,255,897

DATED : October 26, 1993

INVENTOR(S) : Kenneth V. Pepper

It is certified that error appears in the above—identified patent and that said Letters Patent is hereby corrected as shown below:

Column 3, line 24, delete "one", insert "once".

Column 6, line 38 (line 3 of Claim 5) after "other" insert --of--.

Signed and Sealed this

Twenty-eighth Day of June, 1994

Bruce Lehman

*Attest:*

BRUCE LEHMAN

*Attesting Officer*

*Commissioner of Patents and Trademarks*